United States Patent [19]

Goldkuhle et al.

[11] 3,934,416

[45] Jan. 27, 1976

[54] CENTRAL HYDRAULIC SYSTEM FOR MARINE DECK EQUIPMENT

[75] Inventors: Werner P. Goldkuhle, Longview; Richard E. Arnold, Dallas; Malcolm Ray Johnson, Flint, all of Tex.

[73] Assignee: LeBus International, Inc., Longview, Tex.

[22] Filed: Feb. 25, 1974

[21] Appl. No.: 445,252

[52] U.S. Cl. ..... 60/484; 60/490; 60/905

[51] Int. Cl.[2] ..... F15B 11/16

[58] Field of Search ..... 60/476, 484, 486, 488, 60/489, 490, 905, 471, 487; 242/75.53; 254/172; 114/230

[56] References Cited

UNITED STATES PATENTS

| | | | |
|---|---|---|---|
| 2,437,520 | 3/1948 | Gunning | 60/416 |
| 2,984,985 | 5/1961 | MacMillin | 60/471 X |
| 3,172,261 | 3/1965 | Govan | 60/327 |
| 3,300,187 | 1/1967 | Saxe | 114/230 UX |
| 3,381,939 | 5/1968 | Brown | 60/490 X |
| 3,550,505 | 12/1970 | Byers | 91/411 R |
| 3,556,484 | 1/1971 | Moller | 60/905 X |
| 3,685,290 | 8/1972 | Krusche | 60/905 X |
| 3,757,524 | 9/1973 | Poyner | 60/905 X |
| 3,800,962 | 4/1974 | Ham | 60/476 |

FOREIGN PATENTS OR APPLICATIONS

| | | | |
|---|---|---|---|
| 1,186,753 | 2/1965 | Germany | 60/490 |

*Primary Examiner*—Edgar W. Geoghegan
*Attorney, Agent, or Firm*—Richards, Harris & Medlock

[57] ABSTRACT

In a central hydraulic system for marine deck machinery, fixed displacement hydraulic motors are utilized to drive anchor winches and standard mooring winches, and variable displacement hydraulic motors are utilized to drive automatic mooring winches. This permits individual regulation of the line pull or tension of the mooring line of each automatic mooring winch. Variable displacement pressure compensated over center pumps are utilized to supply hydraulic fluid for operating the hydraulic motors by means of a closed loop circuit, and charging pumps are utilized to supply hydraulic fluid at charging pressure.

Infinitely variable volume pressure compensated pilot operated four-way directional valves are used to regulate the flow of hydraulic fluid from the variable displacement pressure compensated over center pumps to the hydraulic motors, thereby regulating the speed of operation of each hydraulic motor and the marine deck winch driven thereby. In certain embodiments pressurized hydraulic fluid from the variable displacement pressure compensated over center pumps is directed to the control ports of the valves, and pressure reducing apparatus is utilized to provide hydraulic fluid at working pressure. In other embodiments control pumps are utilized to direct hydraulic fluid at control pressure to the pilot ports of the valves. In either case hydraulic circuitry including at least one infinitely variable volume four-way directional valve and adapted for actuation from spaced points on the deck of a vessel is utilized to selectively reduce the pressure in the pilot ports of each infinitely variable volume pressure compensated pilot operated four-way directional valve, thereby actuating the valve to direct a predetermined volume of hydraulic fluid to the associated hydraulic motor. Hydraulic fluid is continuously drained through each hydraulic motor and through the hydraulic circuitry associated with each infinitely variable volume pressure compensated pilot operated four-way directional valve, thereby preventing any possibility that the drive system will be disabled due to clogging of the hydraulic lines with low temperature oil.

A brake is utilized in conjunction with each marine deck winch, to prevent operation of the winch when the associated hydraulic motor is not operating. A hydraulic actuator is provided for disabling each brake whenever the associated infinitely variable volume pressure compensated pilot operated four-way directional valve is utilized to direct hydraulic fluid to the hydraulic motor that drives the marine deck winch. In certain embodiments pressurized hydraulic fluid directed from the valve to the motor is also directed through a relief valve to the hydraulic actuator of the associated brake to effect release of the brake. In other embodiments, pressurized hydraulic fluid is continuously supplied to the actuator and a valve is utilized to effect operation of the actuator to release the brake. In such cases the valve which controls the hydraulic actuator may either be coupled directly to the associated infinitely variable volume pressure compensated pilot operated four-way directional valve or may comprise a pilot operated valve connected in parallel with the infinitely variable volume pressure compensated pilot operated four-way directional valve for operation in synchronism therewith.

26 Claims, 6 Drawing Figures

CENTRAL HYDRAULIC SYSTEM FOR MARINE DECK EQUIPMENT

BACKGROUND AND SUMMARY OF THE INVENTION

This invention relates to central hydraulic systems for marine deck machinery, and more particularly to a system providing both infinitely variable control of the operating speed of deck winches and fully automatic mooring winch operation.

It has long been recognized that the mooring lines used to connect a vessel to an adjacent pier or the like must be either paid out or taken in as the positioning of the vessel changes relative to the pier under the action of tides and similar factors. It is also considered necessary to accommodate selection of the line pull or tension of each mooring line on an individual basis. This is to facilitate mooring of the vessel in such a way that certain portions of the vessel are substantially prevented from moving with respect to the pier while permitting at least limited movement of other portions of the vessel. The necessity of providing selectable line pull is especially pronounced in the case of large vessels of the type known as super tankers because the extreme length of such vessels functions to multiply the effect of any motion of the vessel relative to the adjacent pier.

Systems for providing automatic mooring winch operation have been known heretofore. In one type of prior art system mooring winches are driven by electric motors equipped with electromechanical servo systems to provide automatic operation. Due to safety considerations this type of drive system cannot be utilized on vessels designed to transport liquified natural gas (LNG) and similar materials unless the electric motors are of the explosion-proof variety. The latter possibility is considered impractical due to the cost of explosion-proof motors.

Steam driven motors equipped with mechanical servo systems have also been utilized to provide automatic mooring winch operation. This is advantageous in one respect because steam generation is necessary on board tankers and similar vessels in order to effect cargo heating, cleaning of empty holds, etc. However, steam driven systems are now considered to be outmoded and for all practical purposes are no longer being specified for use on U.S. built vessels.

The prior art also includes hydraulic drive systems for marine deck equipment. Heretofore, these systems have utilized special reducing valves and relief valves in order to control the line pull or tension that is applied to the mooring line by the winch. This is considered unsatisfactory because any malfunction in the operation of these components, particularly with respect to the proper settings of the valves, can result in a complete burnout of the system. Also, certain prior art hydraulic drive systems have utilized dump valves to return excess pressurized hydraulic fluid to the storage reservoir and have therefore been highly inefficient.

The present invention comprises a novel drive system for marine deck equipment which fulfills the above-described operating requirements of such a system and simultaneously provides superior operating performance when compared with the performance characteristics of prior art systems. In accordance with the broader aspects of the invention, each marine deck winch is driven by a reversible hydraulic motor. The flow of pressurized hydraulic fluid to each hydraulic motor is regulated by an infinitely variable volume pressure compensated four-way directional valve to afford precise control over the speed of operation of the associated hydraulic motor and the marine deck winch driven thereby. The hydraulic motors which drive automatic mooring winches are variable displacement hydraulic motors. This permits individual regulation of the line pull or tension of the mooring line of each automatic mooring winch.

In accordance with more specific aspects of the invention, one or more variable displacement pressure compensated over center hydraulic pumps are used to supply pressurized hydraulic fluid for operating the hydraulic motors by means of a closed loop circuit. The infinitely variable volume pressure compensated four-way directional valve comprises pilot-operated valves, and hydraulic fluid at control pressure is supplied to the pilot ports at both ends of each valve. In certain embodiments of the invention hydraulic fluid from the variable displacement pressure compensated over center pumps is applied directly to the pilot ports of the valves, and pressure reducing apparatus is utilized to supply hydraulic fluid at working pressure. In other embodiments of the invention separate control pumps are utilized to supply hydraulic fluid at control pressure to the pilots ports of the infinitely variable volume pressure compensated four-way directional valves.

Each infinitely variable volume pressure compensated pilot operated four-way directional valve has associated therewith hydraulic circuitry for reducing the pressure in a selected pilot port of the valve and thereby actuating the valve to direct hydraulic fluid at working pressure to the associated hydraulic motor. This hydraulic circuitry includes at least one infinitely variable volume four-way directional valve for bleeding hydraulic fluid from a selected pilot port. The circuitry may include multiple valves connected in parallel and situated at spaced apart points on the deck of the vessel. Alternatively, mechanical linkages may be provided for operating a single valve from spaced apart points on the deck of the vessel.

Each marine deck winch of the vessel is provided with a brake which functions to prevent operation of the winch whenever the associated hydraulic motor is not operating. Each brake is provided with a hydraulic actuator which functions to disable the brake whenever the associated infinitely variable volume pressure compensated pilot operated four-way directional valve is actuated to direct pressurized hydraulic fluid to the hydraulic motor. In certain embodiments of the invention the pressurized hydraulic fluid which is directed to the hydraulic motor is also directed to the hydraulic actuator of the associated brake through a sequence valve. In other embodiments of the invention pressurized hydraulic fluid is continuously directed to the hydraulic actuator of each brake and a valve adapted for operation in concurrence with the operation of the associated infinitely variable volume pressure compensated pilot operated four-way directional valve to pressurize the associated hydraulic motor is utilized to control operation of the hydraulic actuator. The valve which controls the operation of the hydraulic actuator may comprise either a valve mechanically linked to the infinitely variable volume pressure conpensated pilot operated four-way directional valve or a pilot operated valve coupled in parallel with the infinitely variable volume pressure compensated pilot operated four-way directional valve for operation in synchronism therewith.

The drive system further includes one or more charging pumps for supplying hydraulic fluid at charging pressure. In certain embodiments of the invention the infinitely variable volume pressure compensated pilot operated four-way directional valves comprise open center valves, in which case hydraulic fluid at charging pressure is supplied through the open center of the valve to the associated hydraulic motor whenever the hydraulic motor is not operating. In other embodiments the infinitely variable volume pressure compensated pilot operated four-way directional valves comprise closed center valves, in which case hydraulic circuitry is provided for directing hydraulic fluid at charging pressure to the hydraulic motors when they are not operating. In both embodiments hydraulic fluid is continuously drained from the motors and from the hydraulic circuitry which is utilized to operate the infinitely variable volume pressure compensated pilot operated four-way directional valves. By this means any possibility that the system will be disabled due to clogging by low temperature hydraulic fluid is completely eliminated.

DESCRIPTION OF THE DRAWINGS

A more complete understanding of the invention may be had by referring to the following Detailed Description when taken in conjunction with the accompanying Drawings, wherein.

DETAILED DESCRIPTION

Figure 1:
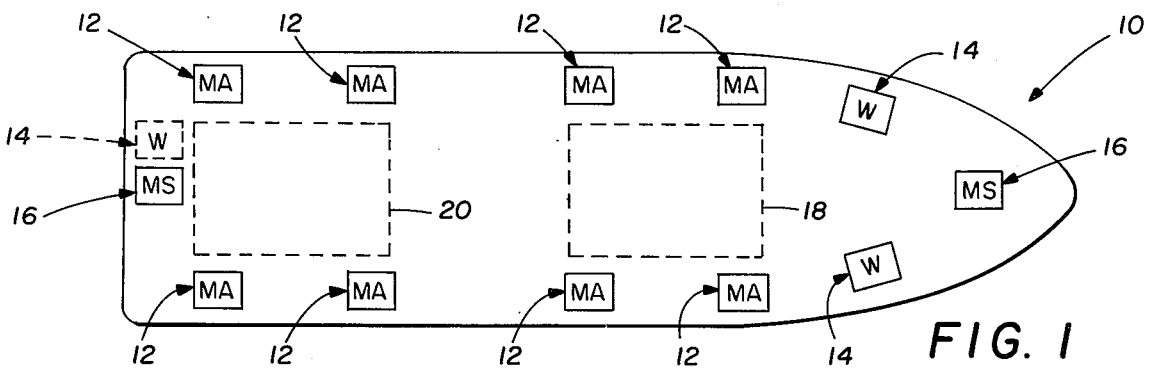
FIG. 1 is a schematic illustration of a vessel having marine deck equipment and utilizing central hydraulic systems for marine deck equipment incorporating the invention.

Referring now to the Drawings, and particularly to FIG. 1 thereof, there is shown a vessel 10 equipped with marine deck equipment and utilizing central hydraulic systems for marine deck equipment incorporating the present invention. While the nature of the vessel and the type of cargo carried thereby are not directly involved in the present invention, the vessel 10 may be of the type known as a "super tanker" and may be adapted for the transportation of liquified natural gas (LNG). Such vessels are characterized by their extremely long length which necessitates the use of mooring winches in which the mooring line pull or tension is individually adjustable. Moreover, due to the extremely volatile nature of liquified natural gas, safety considerations dictate the use of a drive system for the deck winches and other equipment of such a vessel which is wholly incapable of generating any sort of electrical spark.

The deck equipment of the vessel 10 includes a plurality of winches which are divided into forward and aft sets. The forward set of deck winches includes four automatic mooring winches 12 each designated MA, two anchor winches 14 each designated W, and a standard mooring winch 16 designated MS. The aft set of mooring winches also includes four automatic mooring winches 12 designated MA and a standard mooring winch 16 designated MS. The aft set of deck winches may also include an optional anchor winch 14 designated W. Those skilled in the art will appreciate the fact that the vessel 10 may include such additional deck winches as topping winches, hoist winches, and various other windlasses and winches designed to suit particular requirements. Moreover, the vessel may be equipped with such hydraulic devices as hose handling cranes, ballast pumps, fire pumps, davits, unloading equipment, etc. In any event, the vessel 10 further includes a forward central hydraulic system 18 operatively associated with all of the deck equipment comprising the forward set and an aft central hydraulic system 20 operatively associated with all of the deck equipment comprising the aft set.

Each deck winch of the vessel 10 is driven by a hydraulic motor individual to it. Moreover, each deck winch is equipped with a brake which functions automatically to prevent operation of the winch whenever its associated hydraulic motor is not operating. Within these limitations the present invention is adapted for use in conjunction with any commercially available marine deck winch.

Figure 2:
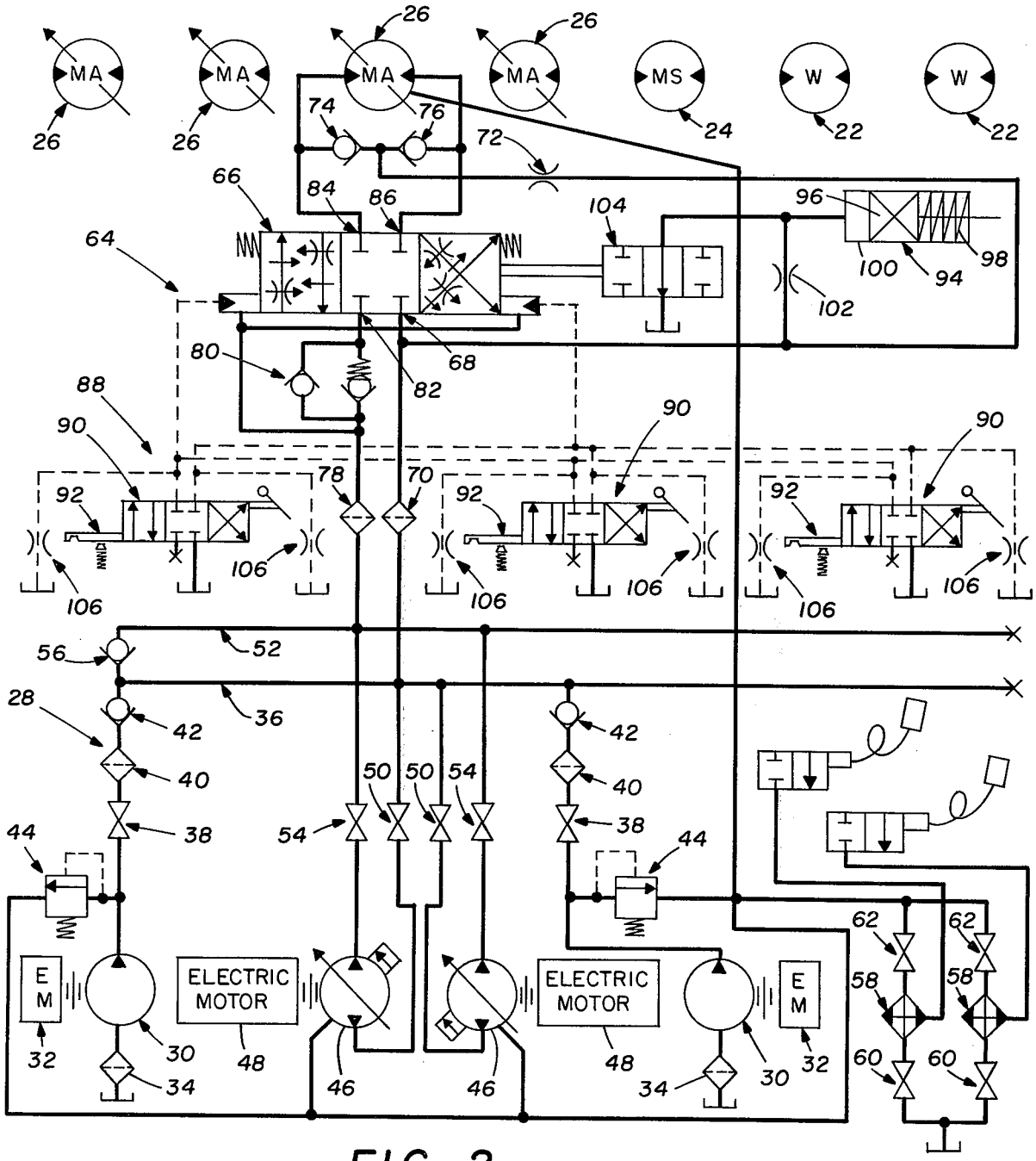
FIG. 2 is a schematic illustration of a central hydraulic system for marine deck equipment incorporating a first embodiment of the invention.

Referring to FIG. 2, each anchor winch W of the vessel 10 is driven by a reversible fixed displacement hydraulic motor 22, and each standard mooring winch 16 MS is driven by a reversible fixed displacement hydraulic motor 24. On the other hand, each automatic mooring winch MA is driven by a reversible variable displacement hydraulic motor 26. Thus, by adjusting the displacement of a particular hydraulic motor 26, the line pull or tension of the mooring line of the associated automatic mooring winch 12 of the vessel 10 may be individually regulated in accordance with particular requirements. It will be understood that the anchor winches W of the vessel 10 may also be equipped with reversible variable displacement hydraulic motors, if desired.

FIG. 2 further illustrates a central hydraulic system 28 which may be utilized in the vessel 10 either as the forward hydraulic system 18 or as the aft central hydraulic system 20, or both. The central hydraulic system 28 includes a pair of charging pumps 30 each driven by an electric motor 32 or other suitable prime mover. The charging pumps 30 each receive hydraulic fluid from a reservoir (shown schematically only) through a filter 34 and direct hydraulic fluid to a header 36 through a valve 38, a filter 40, and a check valve 42 at a predetermined charging pressure as regulated or by a relief valve 44. A pair of variable displacement pressure compensated over center pumps 46 are driven by a pair of electric motors 48 individual thereto or other suitable prime movers. The pumps 46 each receive hydraulic fluid from the header 36 at charging pressure through a valve 50 and direct hydraulic fluid at control pressure to a header 52 through a valve 54. A check valve 56 is connected between the headers 52 and 36.

The central hydraulic system 28 further includes a pair of water-to-oil heat exchangers 58 which are utilized to return spent hydraulic fluid to the reservoir through a pair of valves 60. The case drain of each hydraulic motor is coupled to the inputs of the heat exchangers 58 through a pair of valves 62. Similarly, the outputs from the relief valves 44 and the case drains of the pumps 46 are returned to the reservoir through the heat exchangers 58. By this means the heat exchangers 58 function to maintain the hydraulic fluid in the system at working temperature.

The headers 36 and 52 are selectively connected to the hydraulic motors of the deck winches of the vessel 10 by combined speed control and brake control circuits 64. It will be understood that the circuit 64 illustrated in FIG. 2 is representative only, and that a similar combined speed control and brake control circuit is utilized to connect the headers 36 and 52 to the hydraulic motor of each deck winch of the vessel 10.

The combined speed control and brake control circuit 64 includes an infinitely variable volume pressure compensated pilot operated four-way directional valve 66. The valve 66 may be of the type manufactured by Sanders Associates, Inc., Instrument Division, Greenier Field, Manchester, N. H., and identified by that company as a LeBus Valve. Other commercially available infinitely variable volume pressure compensated pilot operated four-way directional valves may also be utilized in the circuit 64, if desired.

The header 36 is connected to a first port 68 of the valve 66 through a filter 70. The header 36 is also coupled to both ports of the associated hydraulic motor 26 through an orifice 72 and a pair of check valves 74 and 76. The header 52 is coupled to both pilot ports of the valve 66 through a filter 78. A pressure reducing apparatus 80 is coupled to the header 52 and is utilized to direct hydraulic fluid at working pressure (typically about 200 psi below control pressure) to a second port 82 of the valve 66. The third and fourth ports 84 and 86 of the valve 66 are coupled to the ports of the associated hydraulic motor 26. By this means the valve 66 functions to control the rate of flow of hydraulic fluid at working pressure to the hydraulic motor 26, and thereby regulates both the speed of operation of the motor 26 and the speed of operation of the automatic mooring winch 12 of the vessel 10 driven by the hydraulic motor 26.

The operation of the valve 66, and therefore the speed of operation of the associated hydraulic motor and the deck winch driven thereby, is regulated by a hydraulic circuit 88. The circuit 88 comprises pilot lines which connect the pilot ports of the valve 66 to three infinitely variable volume four-way directional valves 90. The valves 90 may comprise any commercially available infinitely variable volume three position four-way directional valve. However, the operating characteristics of the drive system are improved if the valves 90 are selected so as to have good metering characteristics.

Upon actuation, each valve 90 functions to reduce the hydraulic pressure in a selected pilot port of the valve 66, thereby causing the valve 66 to move off center. This allows hydraulic fluid at working pressure to flow through the valve 66 to the associated hydraulic motor, thereby effecting operation of the motor. The speed of operation of the motor and the winch driver thereby depends upon the extent to which the valve 66 has been opened which in turn is directly proportional to the extent to which one of the valves 90 has been opened.

Three valves 90 are utilized in the circuit 88 in order to facilitate operation of the deck winch driven by the hydraulic motor associated with the circuit from a point immediately adjacent the winch and from spaced apart points situated adjacent the deck rails on the opposite sides of the vessel 10. Those skilled in the art will appreciate the fact that the same result can be obtained by means of a single valve 90 situated at a predetermined location and mechanically linked to auxiliary control handles situated at spaced apart points on the deck of the vessel.

The combined speed control and brake control circuits 64 associated with the hydraulic motors 26 which drive the automatic mooring winches 12 of the vessel 10 differ somewhat from similar circuits associated with the hydraulic motors 24 and 22 which drive the standard mooring winches 16 and the anchor winches 14 of the vessel 10. Thus, at least one of the valves 90 of each circuit 64 associated with the hydraulic motor of an automatic mooring winch is equipped with a detent 92 which functions to retain the valve 90 in the condition in which the valve 66 is operated to cause the associated hydraulic motor 26 to operate the automatic mooring winch in such a direction as to reel in its mooring cable. When the circuit 64 is operating in this mode, the mooring winch functions to continuously apply a predetermined line pull or tension to its mooring cable as determined by the setting of the associated variable displacement hydraulic motor 26.

Assuming that a change in the tide level or similar conditions necessitates reeling in of the mooring line, each hydraulic motor 26 operates as a motor to cause the associated winch to accumulate cable. The predetermined line pull is maintained on the mooring line both during and after the reeling operation. On the other hand, if such conditions necessitate the paying out of cable, the hydraulic motor 26 functions as a pump to return pressurized hydraulic fluid to the pressure compensated variable displacement over center hydraulic pumps 46 through the closed loop circuit interconnecting the motors and the pumps. The pumps 46 then shift over center to operate as motors and return energy to the associated prime movers while simultaneously operating as relief valves to maintain pressure in the closed loop circuit at compensator setting. In this manner, the automatic mooring winches 12 of the vessel 10 serve both to maintain a preselected line pull or tension and to reel in or pay out mooring line as needed.

Each deck winch of the vessel 10 has incorporated therein a brake which functions to prevent dropping of the load supported by the winch when the associated hydraulic motor is not operating. An actuator 94 is coupled to each brake and includes a piston 96 biased by a spring 98 to normally apply the brake and thereby prevent operation of the deck winch incorporating the brake. The piston is mounted for reciprocation in a hydraulic cylinder 100 and hydraulic fluid at charge pressure is continuously supplied to the cylinder 100 through an orifice 102. A valve 104 normally connects the interior of the cylinder 100 to the reservoir, and thereby prevents any build-up of hydraulic pressure within the cylinder 100.

The valve 104 is mechanically linked to the infinitely variable volume pressure compensated pilot operated four-way directional valve 66. Thus, whenever the valve 66 is actuated to direct hydraulic fluid at working pressure to the associated hydraulic motor 26, the valve 104 is immediately moved off center, thereby preventing the flow of hydraulic fluid from the cylinder 100 to the reservoir, it being understood that the valve 66 functions to fully pressurize the motor 26 prior to closing of the valve 104. Hydraulic fluid flowing into the cylinder 100 through the orifice 102 thereupon operates the piston 96 to disable the brake and permit operation of the deck winch incorporating the brake under the action of the associated hydraulic motor.

An important feature of the present invention relates to the fact that hydraulic fluid is continuously drained from the pilot lines comprising the hydraulic circuit 88 through orifices 106. Similarly, whenever the associated hydraulic motor is not operating, hydraulic fluid continuously flows from the motor through the case drain and is returned to the reservoir through the heat exchangers 58. Finally, when the hydraulic motor is not operating hydraulic fluid continuously flows through the orifice 102 and is returned to the reservoir through the valve 104. By this means hydraulic fluid at working temperature is continuously circulated through all of the components of the combined speed control and brake control circuit 64. This prevents any possibility of disabling the circuit and hence the entire drive system due to clogging by cold hydraulic fluid, such as might otherwise occur during operation of the vessel 10 in arctic climates, or the like.

Figures 3, 4:
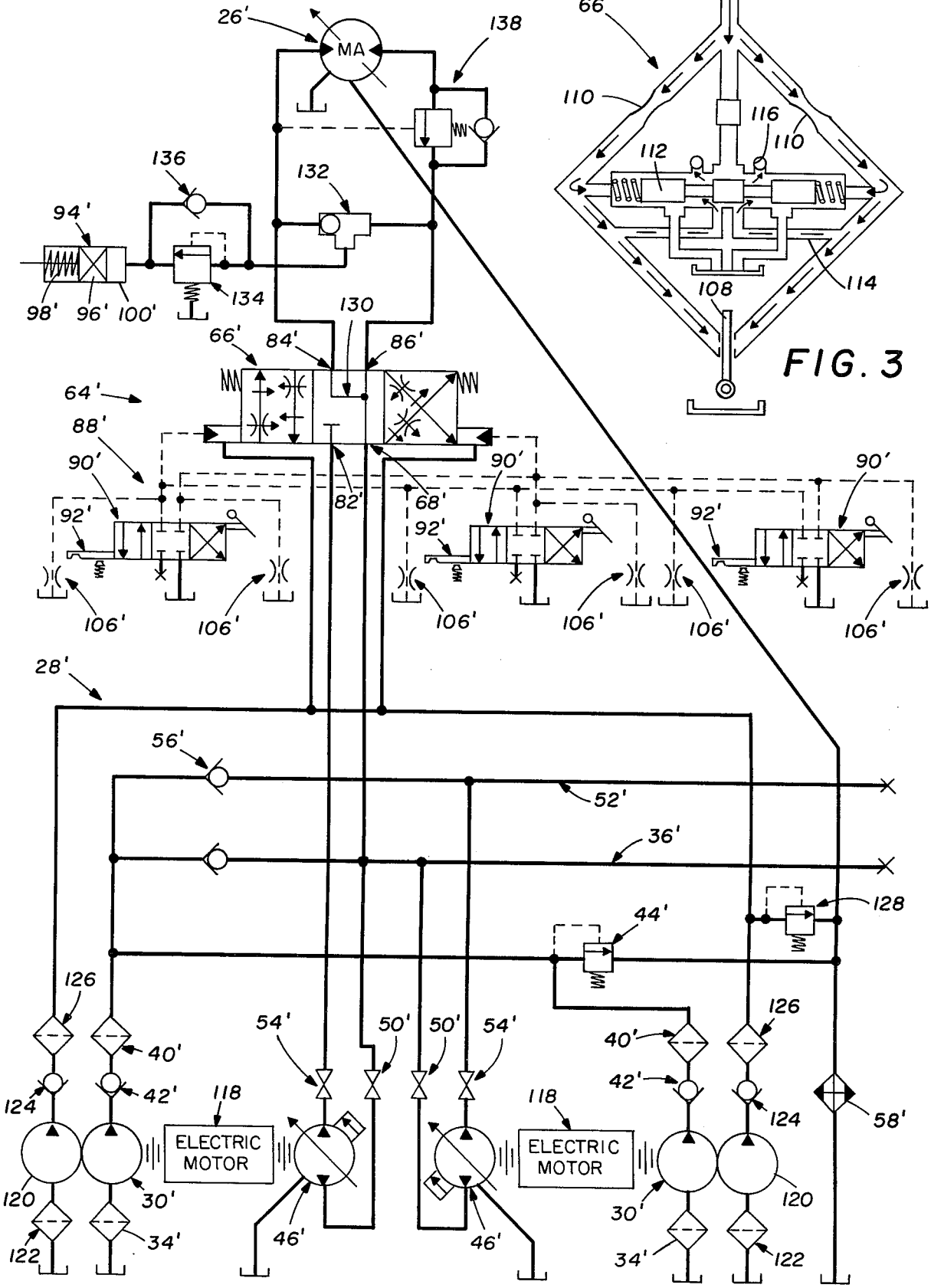
FIG. 3 is a schematic illustration of an infinitely variable volume pressure compensated pilot operated four-way directional valve useful in hydraulic systems incorporating the invention.
FIG. 4 is a schematic illustration of a central hydraulic system for marine deck equipment incorporating a second embodiment of the invention.

A more complete understanding of the operation of the infinitely variable volume pressure compensated pilot operated four-way directional valve 66 of the combined speed control and brake control circuit 64 may be had by reference to FIG. 3, wherein the valve 66 is schematically illustrated. Assuming that a control plate 108 is initially centered, pressurized hydraulic fluid entering the valve 66 passes through a pair of fixed orifices 110 and then out of the valve to the reservoir.

However, if the plate 108 is pivoted to the right, pressure is reduced in the left-hand side of the valve and increased in the right-hand side of the valve. This causes the spool 112 of the valve to shift to the left, thereby permitting flow of hydraulic fluid through a passageway 114 and an outlet orifice 116. This tends to reduce the pressure in the right-hand side of the valve, whereupon the valve again comes into balance. Thus, the rate of flow through an orifice 116 depends directly on the extent of pivotal movement of the plate 108. The valve 66 illustrated in FIG. 2 operates similarly except that the operation of the valve is regulated by the hydraulic circuit 88 rather than by the positioning of the control plate.

A drive system for marine deck winches incorporating a second embodiment of the invention is illustrated in FIG. 4. Many of the component parts of the drive system of FIG. 4 are equivalent in construction and function to component parts of the drive system illustrated in FIG. 2. Such equivalent parts are indicated by reference numerals identical to those utilized heretofore in connection with the description of the drive system shown in FIG. 2, but are differentiated therefrom by means of a prime (′) designation.

One difference between the two drive systems relates to the fact that on the central hydraulic system 28′ of the drive system shown in FIG. 4, double-ended electric motors 118 are utilized both to drive the variable displacement pressure compensated over center pumps 46′ and the charging pumps 30′. The motors 118 also drive a pair of control pumps 120. The control pumps 120 each function to withdraw hydraulic fluid from the reservoir through a filter 122 and to direct hydraulic fluid through a check valve 124 and a filter 126 to the pilot ports of the infinitely variable volume pressure compensated pilot operated four-way directional valve 66′ at a predetermined control pressure which is regulated by a relief valve 128. This eliminates the use of a pressure reducing apparatus to supply hydraulic fluid at working pressure to the port 82′ of the valve 66′.

A major distinction between the combined speed control and brake control circuit 64′ of the drive system of FIG. 4 and the combined speed control and brake control circuit 64 of the drive system of FIG. 2 relates to the fact that the infinitely variable volume pressure compensated pilot operated four-way directional valve 66′ comprises an open center valve. Thus, whenever the valve 66′ is not actuated to direct hydraulic fluid at working pressure to the hydraulic motor 26′, hydraulic fluid at charge pressure is directed from the header 36′ to both ports of the motor 26′ through the port 68′, the open center connection 130, and the ports 84′ and 86′ of the valve 66′. This eliminates the necessity of providing a circuit path including an orifice and opposed check valves to direct hydraulic fluid at charge pressure to the hydraulic motor 26′ when the motor is not operating.

The ports 84′ and 86′ of the infinitely variable volume pressure compensated pilot operated four-way directional valve 66′ are connected to the valve 132. Whenever the valve 66′ is actuated to direct hydraulic fluid at working pressure to the hydraulic motor 26, the valve 132 directs hydraulic fluid at working pressure to the cylinder 100′ through a sequence valve 134. The piston 96′ is thereby actuated to release the brake of the deck winch driven by the associated hydraulic motor 26′. When the valve 66′ is substantially actuated to terminate operation of the motor 26′, pressurized hydraulic fluid is drained from the cylinder 100′ through a check valve 136, whereupon the spring 98′ functions to apply the brake, thereby terminating operation of the deck winch. A counterbalance valve 138 is utilized in the circuit 64′ to prevent the winch from dropping the load supported thereby until the brake is set.

Figure 5:
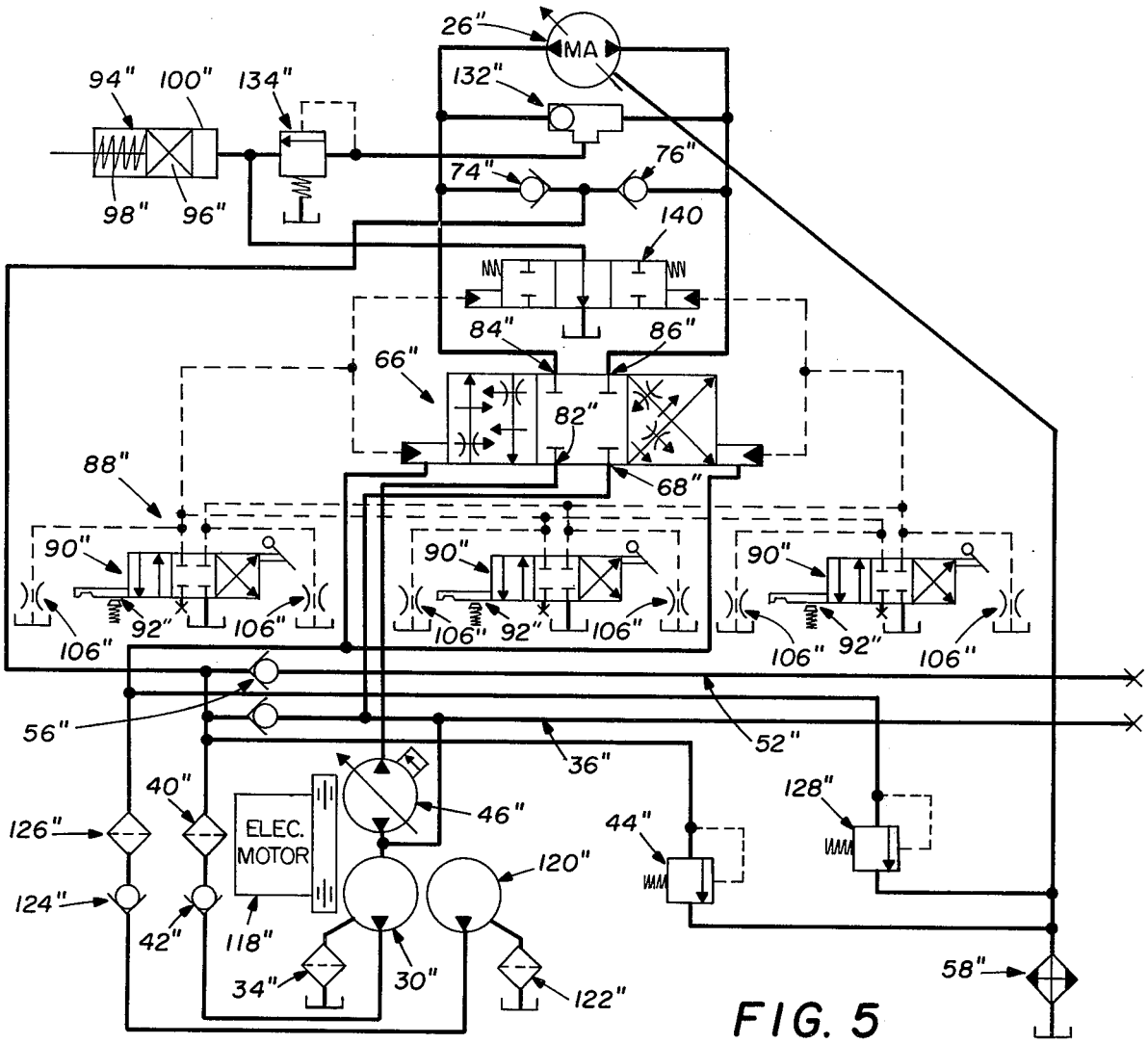
FIG. 5 is a schematic illustration of a central hydraulic system for marine deck equipment incorporating a third embodiment of the invention.

A drive system for marine deck winches incorporating a third embodiment of the invention is illustrated in FIG. 5. Many of the component parts of the drive system of FIG. 5 are equivalent in construction and function to component parts of the drive system illustrated in FIGS. 2 and 4. Such equivalent parts are indicated by reference numerals identical to those utilized hereinbefore in connection with the description of the drive systems of FIGS. 2 and 4, but are differentiated therefrom by means of a double prime (″) designation.

The primary distinction between the drive system of FIG. 5 and the drive systems of FIGS. 2 and 4, relates to the apparatus for actuating and releasing the brake of the deck winch driven by the hydraulic motor 26″. The cylinder 100″ of the brake actuator 94″ is coupled to a pilot operated three postion two-way valve 140 which is coupled in parallel with the infinitely variable volume pressure compensated pilot operated three position four-way directional valve 66″. Thus, the valve 140 functions to prevent any build-up of hydraulic pressure in the cylinder 100″ whenever the valve 66″ is not actuated to direct hydraulic fluid at working pressure to the hydraulic motor 26''.

Actuation of the hydraulic circuit 88'' to commence operation of the motor 26'' immediately moves both the valve 66'' and the valve 140 off center. The valve 132'' thereupon directs hydraulic fluid at working pressure to the cylinder 100'' through the sequence valve 134''. The piston 96'' is thus actuated to release the brake, thereby permitting operation of the marine deck winch incorporating the brake under the action of the hydraulic motor 26''.

Actuation of the circuit 88'' to stop the motor 26'' causes both the valve 66'' and the valve 140 to return to the conditions schematically illustrated in FIG. 5. The valve 140 thereupon immediately exhausts the cylinder 100'' of the brake actuator 94''. The spring 98'' then causes the piston 96'' to set the brake, thereby preventing the deck winch incorporating the brake from dropping its load.

Figure 6:
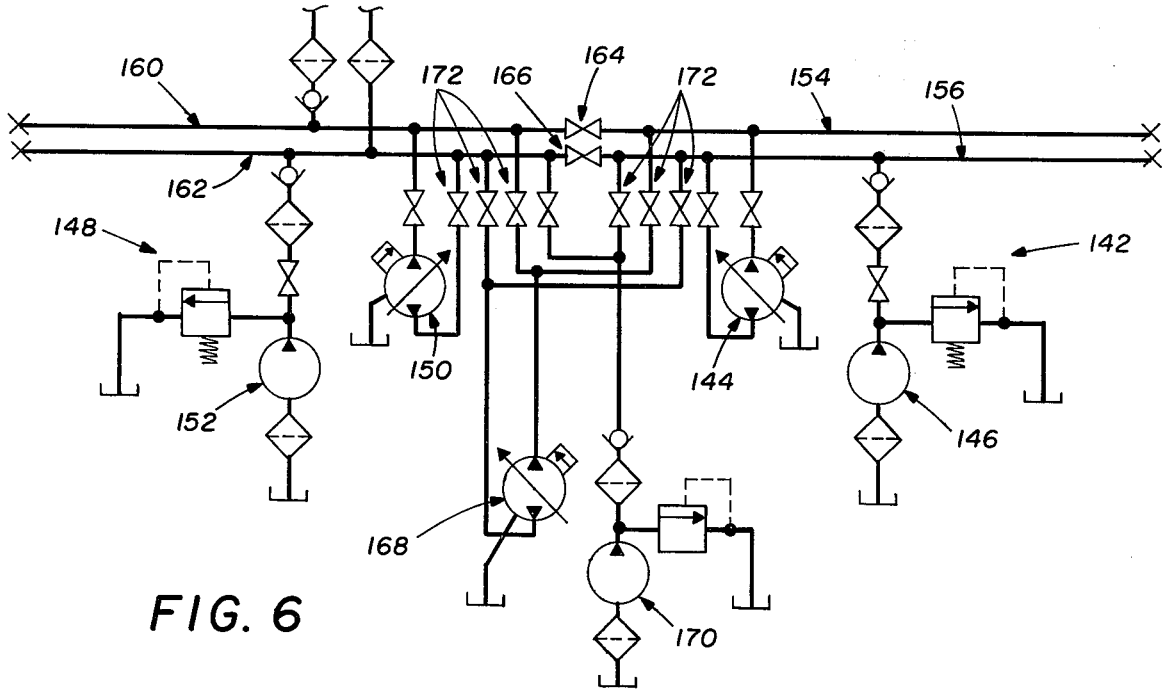
FIG. 6 is an illustration of a hydraulic interconnection system which may be used in conjunction with the systems of FIGS. 2, 4 and 5.

In FIG. 6 there is shown a system for interconnecting the forward and aft central hydraulic systems of a vessel utilizing drive systems for marine deck winches incorporating the present invention, and also providing both a reserve source of hydraulic fluid at operating pressure and a reserve source of hydraulic fluid at charge pressure. A forward central hydraulic system 142 includes a variable displacement pressure compensated over center pump 144 for supplying hydraulic fluid at operating pressure and a charge pump 146 for supplying hydraulic fluid at charge pressure. The pumps 144 and 146 are driven by a common prime mover, which may comprise an electric motor, a diesel engine, etc. Similarly, an aft hydraulic system 148 includes a variable displacement pressure compensated pump 150 for supplying hydraulic fluid at operating pressure and a charge pump 152 for supplying hydraulic fluid at charge pressure. The pumps 150 and 152 may be driven by a common prime mover, such as an electric motor, a diesel engine, etc.

Hydraulic fluid at operating pressure is received from the pump 144 in a forward header 154 and is delivered thereby to the combined speed control and brake control circuit of the hydraulic motor associated with each deck winch at the forward end of the vessel. Similarly, hydraulic fluid at charge pressure is received from the charge pump 146 in a forward header 156 and is directed thereby to the combined speed control and brake control circuit of the hydraulic motor of each deck winch at the forward end of the vessel. Hydraulic fluid at operating pressure is received from the variable displacement pressure compensated pump 150 in an aft header 160 and is directed thereby to the combined speed control and brake control circuit of the hydraulic motor of each deck winch at the aft end of the vessel. Similarly, hydraulic fluid at charge pressure is received from the charge pump 152 in an aft header 162 and is directed thereby to the combined speed control and brake control circuit of the hydraulic motor of each deck winch at the aft end of the vessel. The forward header 154 is connected to the aft header 160 by a normally closed manually operable valve 164, and the forward header 156 is connected to the aft header 162 by a normally closed manually operable valve 166. By means of the valves 164 and 166 hydraulic fluid at operating pressure and at charge pressure can be directed from the central hydraulic system 142 to the combined speed control and brake control circuits of the hydraulic motors of the deck equipment at the aft end of the vessel should the need arise, and likewise hydraulic fluid at operating pressure and at charge pressure can be directed from the aft central hydraulic system 148 to the combined speed control and brake control circuits of the hydraulic motors of the deck equipment at the forward end of the vessel, should the need arise.

FIG. 6 further illustrates a variable displacement pressure compensated over center pump 168 adapted to supply hydraulic fluid at operating pressure and a charge pump 170 adapted to supply hydraulic fluid at charge pressure. The pumps 168 and 170 are both driven by the service engine of the vessel. Thus, should the need arise, the pump 168 may be utilized to supply pressurized hydraulic fluid at operating pressure either to the forward header 154 or to the aft header 156. Similarly, the pump 170 may be utilized to direct hydraulic fluid at charge pressure either to the forward header 156 or to the aft header 162. All such connections are accommodated by means of a plurality of normally closed manually operable valves 172.

As will be appreciated by those skilled in the art the drive systems for marine deck engines illustrated in the drawings and described hereinbefore are adapted for numerous rearrangements and modifications. For example, the drive systems illustrated in FIGS. 4 and 5 may be provided with pressure reducing apparatus such as the pressure reducing apparatus 80 of the drive system of FIG. 2 for supplying hydraulic fluid at working pressure to the ports 82' and 82'' of the valves 66' and 66'', respectively. In such cases, the control pumps 120 and 120'' would be eliminated from the drive systems of FIGS. 4 and 5, respectively. Conversely, the pressure reducing apparatus 80 of the drive system of FIG. 2 may be eliminated, in which case a pair of control pumps would be utilized to supply hydraulic fluid at control pressure to the pilot ports of the valve 66.

Another important potential rearrangement relates to the brake actuating and releasing systems of the three drive systems. It will be understood that the brake actuating and releasing systems described in conjunction with the drive systems of FIGS. 2, 4 and 5 may be interchanged between the three systems, if desired. Perhaps more importantly, the pilot operated two-way valve 140 of the drive system of FIG. 5 may be utilized in the drive system of FIG. 2 in lieu of the valve 104, if desired, and vice versa.

From the foregoing, it will be understood that the present invention comprises a drive system for marine deck winches incorporating numerous advantages over the prior art. Perhaps most importantly, the system provides fully automatic mooring winch operation and also provides complete control over the speed of operation of the deck winches of a vessle. Another important advantage in the use of the invention relates to the fact that drive systems constructed in accordance therewith are fully hydraulic in nature, thereby eliminating any possibility of electrical spark when the invention is used on vessels of the type adapted to transport liquified natural gas and similar volatile materials.

Although preferred embodiments of the invention have been illustrated in the Drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A central hydraulic system for a plurality of marine deck equipment comprising:

variable displacement over center pump means for supplying hydraulic fluid at a predetermined pressure;

a plurality of hydraulic motors each individual to and drivingly connected to one of the marine deck equipment and each adapted for actuation by pressurized hydraulic fluid supplied by the variable displacement over center pump means to drive its associated marine deck equipment;

closed loop circuit means interconnecting the pump means and the motors;

a plurality of infinitely variable volume pressure compensated valves each individual to one of the hydraulic motors and each adapted to control the volume of pressurized hydraulic fluid flowing to its associated hydraulic motor and thereby regulate the speed of operation of the associated marine deck equipment;

a plurality of brake means each individual to one of the marine deck equipment and each for normally preventing operation of its associated equipment;

hydraulic actuator means individual to each brake means and adapted for actuation by pressurized hydraulic fluid supplied by the variable displacement pump means to disable the brake means and thereby permit operation of the associated equipment; and hydraulic circuit means responsive to actuation of the associated infinitely variable volume pressure compensated valve to direct pressurized hydraulic fluid to the associated hydraulic motor for actuating the associated hydraulic actuator means and thereby disabling the associated brake means;

said hydraulic circuit means including valve means for receiving pressurized hydraulic fluid from the connections between the associated infinitely variable volume pressure compensated valve and the associated hydraulic motor and sequence valve means for directing pressurized hydraulic fluid to the hydraulic actuator whenever the differential between the hydraulic pressure in the connections extending from the infinitely variable volume pressure compensated valve and the hydraulic motor exceeds a predetermined level.

2. A central hydraulic system for a plurality of marine deck equipment comprising:

variable displacement over center pump means for supplying hydraulic fluid at a predetermined pressure;

a plurality of hydraulic motors each individual to and drivingly connected to one of the marine deck equipment and each adapted for actuation by pressurized hydraulic fluid supplied by the variable displacement over center pump means to drive its associated marine deck equipment;

closed loop circuit means interconnecting the pump means and the motors;

a plurality of infinitely variable volume pressure compensated valves each individual to one of the hydraulic motors and each adapted to control the volume of pressurized hydraulic fluid flowing to its associated hydraulic motor and thereby regulate the speed of operation of the associated marine deck equipment;

a plurality of brake means each individual to one of the marine deck equipment and each for normally preventing operation of its associated equipment;

hydraulic means individual to each brake means and adapted for actuation by pressurized hydraulic fluid supplied by the variable displacement pump means to disable the brake means and thereby permit operation of the associated equipment; and means responsive to actuation of the associated infinitely variable volume pressure compensated valve to direct pressurized hydraulic fluid to the associated hydraulic motor for actuating the associated hydraulic means and thereby disabling the brake means;

said hydraulic means being actuated by valve means mechanically coupled to the infinitely variable volume pressure compensated valve for actuation in conjunction therewith.

3. A central hydraulic system for a plurality of marine deck equipment comprising:

variable displacement over center pump means for supplying hydraulic fluid at a predetermined pressure;

a plurality of hydraulic motors each individual to and drivingly connected to one of the marine deck equipment and each adapted for actuation by pressurized hydraulic fluid supplied by the variable displacement over center pump means to drive its associated marine deck equipment;

closed loop circuit means interconnecting the pump means and the motors;

a plurality of infinitely variable volume pressure compensated valves each individual to one of the hydraulic motors and each adapted to control the volume of pressurized hyraulic fluid flowing to its associated hydraulic motor and thereby regulate the speed of operation of the associated marine deck equipment;

a plurality of brake means each individual to one of the marine deck equipment and each of noramlly preventing operation of its associated equipment;

hydraulic means individual to each brake means and adapted for actuation by pressurized hydraulic fluid supplied by the variable displacement pump means to disable the brake means and thereby permit operation of the associated equipment; and means responsive to actuation of the associated infinitely variable volume pressure compensated valve to direct pressurized hydraulic fluid to the associated hydraulic motor for actuating the associated hydraulic means and thereby disabling the brake means;

said hydraulic means being actuated by valve means hydraulically coupled to the associated infinitely variable volume pressure compensated valve for operation in conjunction therewith.

4. A drive system for a marine deck winch comprising:

pressure compensated variable displacement over center pump means for supplying hydraulic fluid at a predetermined operating pressure;

charging pump means for supplying pressurized hydraulic fluid at a predetermined charging pressure;

an infinitely variable volume pressure compensated pilot operated four-way directional valve;

means for directing hydraulic fluid at control pressure to pilot ports at both ends of the valves;

pressure reducing means for supplying hydraulic fluid at working pressure to a first port of the valve;

means for connecting the output of the charging pump means to a second port of the valve;

a reversible hydraulic motor drivingly connected to the marine deck winch;

means connecting the ports of the hydraulic motor to third and fourth ports of the valve; and hydraulic circuit means for selectively reducing the pressure in one of the pilot ports of the infinitely variable volume pressure compensated pilot operated four-way directional valve and thereby causing the valve to direct hydraulic fluid at working pressure and at a selected flow rate to the hydraulic motor so that the hydraulic motor drives the marine deck winch at a predetermined speed.

5. The drive system according to claim 4 wherein the hydraulic circuit means includes hydraulic valve means for actuation to reduce pressure in the pilot port at one end of the infinitely variable volume pressure compensated pilot operated four-way directional valve at a predetermined rate and thereby actuating the valve to direct hydraulic fluid at working pressure at a predetermined rate to the hydraulic motor.

6. The drive system according to claim 5 further characterized by means for actuating the hydraulic circuit means from spaced apart points on the deck of a vessel.

7. The drive system according to claim 4 further including:

brake means for normally preventing operation of the marine deck winch;

hydraulic actuator means for disabling the brake means and thereby permitting operation of the marine deck winch under the action of the hydraulic motor; and means responsive to operation of the infinitely variable volume pressure compensated pilot operated four-way directional valve to supply hydraulic fluid at working pressure to the hydraulic motor for actuating the hydraulic actuator means to disable the brake means.

8. The drive system according to claim 4 wherein the hydraulic circuit means includes valve means for receiving pressurized hydraulic fluid from the connections between the infinitely variable volume pressure compensated pilot operated four-way directional valve and the hydraulic motor and sequence valve means for directing pressurized hydraulic fluid to the hydraulic actuator whenever the differential between the hydraulic pressure in the connections extending from the infinitely variable volume pressure compensated pilot operated four-way directional valve and the hydraulic motor exceeds a predetermined level.

9. The drive system according to claim 7 wherein the hydraulic actuator actuating means comprises valve means mechanically coupled to the infinitely variable volume pressure compensated pilot operated four-way directional valve for operation in conjunction therewith.

10. The drive system according to claim 7 wherein the hydraulic actuator actuating means comprises valve means hydraulically coupled to the infinitely variable volume pressure compensated pilot operated four-way directional valve for operation in conjunction therewith.

11. The drive system according to claim 14 further characterized by means for continuously circulating hydraulic fluid at working temperature through the component parts of the system and thereby preventing malfunction of the system due to clogging due to low temperature oil.

12. A drive system for a marine deck winch comprising:

pressure compensated variable displacement over center pump means for supplying hydraulic fluid at a predetermined working pressure;

charging pump means for supplying pressurized hydraulic fluid at a predetermined charging pressure;

control pump means for supplying hydraulic fluid at a predetermined control pressure;

an infinitely variable volume pressure compensated pilot operated four-way directional valve;

means for directing hydraulic fluid at control pressure from the control pump means to pilot ports at both ends of the valve;

means for directing hydraulic fluid at working pressure from the pressure compensated variable displacement pump means to a first port of the valve;

means for directing hydraulic fluid at charging pressure from the charging pump means to a second port of the valve;

a reversible hydraulic motor drivingly connected to the marine deck winch;

means connecting the ports of the hydraulic motor to third and fourth ports of the valve; and hydraulic circuit means for selectively reducing the pressure in a selected on of the pilot ports of the infinitely variable volume pressure compensated pilot operated four-way directional valve and thereby causing the valve to direct hydraulic fluid at working pressure and at a selected flow rate to the hydraulic motor and thereby driving the marine deck winch at a predetermined speed.

13. The drive system according to claim 12 wherein the hydraulic circuit means includes at least one infinitely variable volume directional valve for selectively bleeding hydraulic fluid from one of the pilot ports of the infinitely variable volume pressure compensated pilot operated four-way directional valve and thereby actuating the valve to direct hydraulic fluid at operating pressure to the hydraulic motor.

14. The drive system according to claim 13 further characterized by means for actuating the hydraulic circuit means to in turn actuate the infinitely variable volume pressure compensated pilot operated four-way directional valve from spaced points on the deck of a vessel.

15. The drive system according to claim 12 further including:

brake means for normally preventing operation of the marine deck winch;

hydraulic actuator means for disabling the brake means and thereby permitting operation of the marine deck winch; and hydraulic circuit means responsive to actuation of the infinitely variable volume pressure compensated pilot operated four-way directional valve to direct hydraulic fluid at operating pressure to the hydraulic motor to actuate the hydraulic actuator, thereby disabling the brake means and permitting operation of the marine deck winch under the action of the hydraulic motor.

16. The drive system according to claim 15 wherein the hydraulic circuit means includes valve means for receiving pressurized hydraulic fluid from the connections between the infinitely variable volume pressure compensated pilot operated four-way directional valve and the hydraulic motor and sequence valve means for directing pressurized hydraulic fluid to the hydraulic actuator whenever the differential between the hydraulic pressure in the connections extending from the infinitely variable volume pressure compensated pilot operated four-way directional valve and the hydraulic motor exceeds a predetermined level.

17. The drive system according to claim 16 wherein the hydraulic circuit means is further characterized by means for directing pressurized hydraulic fluid to the hydraulic actuator, and valve means coupled to the hydraulic actuator for normally preventing operation of the hydraulic actuator and responsive to actuation of the infinitely variable volume pressure compensated pilot operated four-way directional valve to direct pressurized hydraulic fluid to the hydraulic motor to permit operation of the hydraulic actuator.

18. The drive system according to claim 17 wherein the valve means for controlling operation of the hydraulic actuator comprises a valve mechanically connected to the infinitely variable volume pressure compensated pilot operated four-way directional valve for operation in conjunction therewith.

19. The drive system according to claim 17 wherein the valve means for controlling the operation of the hydraulic actuator comprises a pilot operated two-way valve connected in parallel with the infinitely variable volume pressure compensated pilot operated four-way directional valve for operation in conjunction therewith.

20. The drive system according to claim 12 further characterized by means for continuously circulating hydraulic fluid at working temperature through the component parts of the system and thereby preventing malfunction of the system due to clogging due to low temperature oil.

21. A drive system for a marine deck winch comprising:

a hydraulic motor having inlet and outlet ports drivingly connected to the marine deck winch and adapted for actuation by pressurized hydraulic fluid to operate the marine deck winch;

pump means for supplying pressurized hydraulic fluid at a predetermined pressure;

valve means for controlling the flow of pressurized hydraulic fluid from the pump means to the hydraulic motor;

brake means for normally preventing operation of the marine deck winch;

hydraulic actuator means for disabling the brake means and thereby permitting operation of the marine deck winch;

means responsive to actuation of the valve means to direct pressurized hydraulic fluid to the hydraulic motor for actuating the hydraulic actuator means to disable the brake means;

said valve means comprising an infinitely variable volume pressure compensated four-way directional valve having four working ports connected to the ports of the hydraulic motor by hydraulic lines, said hydraulic actuator actuating means including valve means having an inlet port for receiving pressurized hydraulic fluid from whichever of the hydraulic lines interconnecting the valve and the motor is at the higher pressure, and sequence valve means for directing pressurized hydraulic fluid to the hydraulic actuator whenever the hydraulic pressure within one of the lines interconnecting the valve and the hydraulic motor exceeds a predetermined level.

22. A drive system for a marine deck winch comprising:

a hydraulic motor having inlet and outlet ports drivingly connected to the marine deck winch and adapted for actuation by pressurized hydraulic fluid to operate the marine deck winch;

pump means for supplying pressurized hydraulic fluid at a predetermined pressure;

first valve means for controlling the flow of pressurized hydraulic fluid from the pump means to the hydraulic motor;

brake means for normally preventing operation of the marine deck winch;

hydraulic actuator means for disabling the brake means and thereby permitting operation of the marine deck winch;

means responsive to actuation of the valve means to direct pressurized hydraulic fluid to the hydraulic motor for actuating the hydraulic actuator means to disable the brake means;

means for supplying pressurized hydraulic fluid to the inlet port of the hydraulic actuator means; and second valve means connected to an outlet port of the hydraulic actuator for normally preventing a build-up of hydraulic pressure therein and responsive to actuation of the first valve means to direct pressurized hydraulic fluid to the motor and close the outlet port of the hydraulic actuator means whereby the hydraulic actuator means is operated under the action of hydraulic fluid received through the inlet port.

23. The drive system according to claim 22 wherein the first valve means comprises an infinitely variable volume pressure compensated pilot operated four-way directional valve and wherein the second valve means for controlling the operation of the hydraulic actuator is mechanically coupled to the infinitely variable volume pressure compensated pilot operated four-way directional valve for operation in conjunction therewith.

24. The drive system according to claim 22 wherein the first valve means for controlling the flow of pressurized hydraulic fluid to the hydraulic motor comprises an infinitely variable volume pressure compensated pilot operated four-way directional valve and wherein the second valve means for controlling the operation of the hydraulic actuator comprises a two-way directional valve connected in parallel with the infinitely variable volume pressure compensated pilot operated four-way directional valve for operation in conjunction therewith.

25. In combination:

a ship having a deck;

a plurality of constant tension marine mooring winches mounted at spaced apart locations on the deck of the ship each for applying a line pull that is variable independently of the line pull setting of any other winch;

a plurality of variable displacement hydraulic motors each individual to and each operatively connected to one of the constant tension marine mooring winches on the deck of the ship;

means for supplying hydraulic fluid at a predetermined working pressure;

closed loop circuit means interconnecting the hydraulic fluid supplying means and each of the variable displacement hydraulic motors; and a plurality of infinitely variable volume pressure compensated pilot operated valves each for controlling the flow of pressurized hydraulic fluid from the supplying means to one of the variable displacement hydraulic motors and thereby regulating the speed of operation of the associated hydraulic motor and the constant tension marine mooring winch operatively connected thereto;

whereby the line tension applied by each constant tension marine mooring winch depends on the setting of the displacement of the associated variable displacement hydraulic motor operatively connected thereto and the speed of operation of the constant tension marine mooring winch depends on the setting of the associated infinitely variable volume pressure compensated pilot operated valve.

26. The combination according to claim 25 further characterized by:

at least one additional winch mounted on the deck of the ship;

a fixed displacement hydraulic motor associated with and operatively connected to the additional winch; and means for controlling the flow of hydraulic fluid from the supplying means to the fixed displacement hydraulic motor and thereby regulating the speed of operation of the fixed displacement hydraulic motor and the additional winch operatively connected thereto.

* * * * *